US005788241A

United States Patent [19]

Ung

[11] Patent Number: 5,788,241

[45] Date of Patent: Aug. 4, 1998

[54] METHOD OF PLAYING A JOKER DOMINOES AND ALTERNATE PLAYING METHODS

[76] Inventor: Peter Heng Ung, 1218 W. Sunset Blvd., #205, Los Angeles, Calif.

[21] Appl. No.: 920,097

[22] Filed: Aug. 26, 1997

[51] Int. Cl.[6] ..... A63F 1/00; A63F 9/20

[52] U.S. Cl. ..... 273/292; 273/293; 273/306

[58] Field of Search ..... 273/292, 306, 273/274, 309, 293; 463/12, 13

[56] References Cited

U.S. PATENT DOCUMENTS

| | | | |
|---|---|---|---|
| 4,659,087 | 4/1987 | Shen et al. | 273/274 |
| 5,411,268 | 5/1995 | Nelson et al. | 273/292 |
| 5,560,613 | 10/1996 | Nguyen | 273/292 |

OTHER PUBLICATIONS

"9's Up", Harrah's Lake Tahoe Resort Casino, Harrah's Gaming Guide, 1988.

*Primary Examiner*—Benjamin H. Layno

[57] ABSTRACT

The present invention is preferably played with dominoes. The preferability of dominoes obtains for the invention the physical sensation of some weight and sound not found with cards or video presentation of a gaming software, although both of those methods are appropriate for playing the game of the present invention.

This present invention comprises a two handed game in which comparison is made between the two hands of a player and a banker. Both hands of the player must have a point total greater than the corresponding two hands of the banker in order to win. Each hand of the player and the banker contain only two dominoes or cards.

8 Claims, 2 Drawing Sheets

METHOD OF PLAYING A JOKER DOMINOES AND ALTERNATE PLAYING METHODS

BACKGROUND OF THE INVENTION

The present invention relates to dual handed games of chance.

The prior art contains several methods of playing games of chance against a "banker", wherein the players and the banker hold separate hands for the purpose of point or value comparison. The following are examples of those prior art games.

U.S. Pat. No. 5,169,148 (to Wheeler, Dec. 8, 1992 for Gaming Apparatus) describes a set of thirteen dice, each die of the set having four display panels. Each of the display panels carries indicia denoting a card of a standard deck of playing cards. The indicia of each of the four panels of each die denote a card of a suit differing from the suits of the cards denoted on the other three panels of the die and further denote a card of a denomination differing from the denominations denoted on the other three panels of the die.

U.S. Pat. No. 5,632,485 (Card game with side bet options) describes a game of Blackjack or "Twenty-One" modified by providing a player with the option of wagering on whether the player will receive a "stiff" hand. As used therein, the term "stiff" is defined as occurring when the first two cards dealt to a player have a hard total of 12 to 16, i.e. 12, 13, 14, 15 or 16, when aces are counted as one. According to another embodiment, a player in a Blackjack game is provided with the option of wagering on whether he will be dealt a non-pair "stiff" hand or a pair of aces. According to a still further embodiment, a player in a Blackjack game is provided with the option of wagering on whether his first two cards will result in a "stiff" hand or a "soft" hand, i.e. that the player's first two cards include an ace and either: 1) any non-ten denomination, i.e., ace through nine or 2) any non-ten and non-ace denomination, i.e. two through nine.

U.S. Pat. No. 5,560,613 (Method of playing California Paigow) describes the method of playing a card game operated among a plurality of players and a house dealer. The method uses a deck of 36 cards. The 36-card deck is obtained from a conventional 52-card deck with an additional two jokers, and all jack, queen, and king cards removed. Additionally, the three of hearts, three of spades, six of hearts, six of spades, nine of hearts, and nine of spades cards are removed. According to the method of the present invention, each player places a wager, and the house dealer deals four cards for each of the players. All of the sets of four cards are placed on the table in a row, and the house dealer assigns the position of banker to one of the players. The banker then picks one of the eight hands, and rolls a set of dice to determine which of the remaining players should receive that hand of four cards. The remaining hands are assigned to the remaining players in an orderly fashion. All of the player's cards are placed face down in an arranged order, except for the banker's hand, which is placed face up in an arranged order. Each player determines the arranged order of his hand. The player's cards are then sequentially compared to the banker's cards, and winners are determined based on the comparison.

U.S. Pat. No. 5,072,946 (Method of playing a wagering casino-type card game) describes a method of playing a game using one or more decks of cards. One card is dealt to a first player and one card is dealt to a second player. The numerical value of the first player's card is compared to the numerical value of the second player's card. If the numerical values are the same, the game is over and the deal is declared a tie. If the numerical value of the first player's hand is not the same as the value of the second player's hand, another card is dealt to the player having the lower numerical value. Again the total numerical values are compared. If a tie now exists, again the game is over and the hand is declared a tie. The dealing of cards to the hand having the lower total numerical value continues until a tie exists or until one of the hands exceeds a predetermined value. Once one of the hands exceeds the predetermined value, the other hand wins. In one variation of this game, any time one of the hands achieves the exact predetermined numerical value, the game ends with that hand being declared the winner. Players may wager on whether the first player's hand, the second player's hand or the tie will win.

U.S. Pat. No. 5,275,415 (Card game) describes a card game and method of playing the same played with a fifty six card deck and played to a predetermined unique point total on a table having a playing surface and several player stations surrounding said table and a card dealer station located between two of the players, and said dealer does not play hands, in which each station where a player is located initially receives two cards face down with the player adding the value of said cards and each player in rotation to receive one or more cards face up or to stand on the original cards in an endeavor to reach the point total, each player playing against the other of said players and a winning player having the point total or a total less than or greater than said point total.

U.S. Pat. No. 5,411,268 (Game of skill and chance) describes a game that uses a standard 52 card deck, and is played by a minimum of an action player, a banker and a dealer. The dealer, deals the playing pieces, but does not act as the banker. The action player and banker place their wagers before the cards are dealt. The dealer deals 4 cards, each to the player and to the banker. The player, but not the banker, looks at his cards and arranges them in a front hand and a back hand and in any order desired. The front hand is to be played first. The banker's cards are turned over and placed in respective front and back hands. The two front hands are compared to show a win, lose or draw, using the rules of the game of Blackjack. If the action player wins, the banker satisfies the extent of the action player's wager, and that round of play terminates, and the remaining players lose their right to play in that round. Otherwise, play proceeds to the next player. If the action player loses, the amount of his wager is given to the banker. In case of a tie, the two back hands are compared to determine a winner and a loser, using the rules of the game of Poker. If there still exists a tie, the outcome is determined by pre-established rules.

U.S. Pat. No. 4,659,087 (Casino game) describes a casino card game for a number of players which is played on a table which includes a station for the House and a number player stations adjacent thereto, each of which stations has positions for two pairs of cards and the player stations having a position for bet made by the player, the game being one in which each player is dealt four cards which the player has to make into two groups of two having a highest value, the value being achieved either by adding the face value of the cards, with the court card having a nominated face value of ten and disregarding the ten digit should there be one, each player playing against the bank, the player having a winning hand, if both of his pairs are higher than both of the bank pairs, a losing hand, if both is his pairs are lower than both of the bank's pairs and a stand-off, if one pair is lower and one pair is higher than the bank's pairs.

U.S. Pat. No. 5,280,915 (Method of playing double action blackjack) describes a method of playing a blackjack game that will enable a blackjack player to make the second initial 21 wager and play the second initial hand on any deal of the cards. The layout of the table includes boxes on each player station where the wagers are placed, and card dealing areas next to each of the boxes where the hands of cards are dealt. The boxes and card dealing areas are spaced sufficiently far enough apart so that players are not deprived a place to place a "21" wager and play at the table. Furthermore, with this layout the dealer and player can clearly determine which cards belongs to the player's first wager and which cards belong to the player's second wager.

U.S. Pat. No. 5,322,295 (Method of playing a multiple hand card game) describes methods of playing card games wherein a player makes a plurality of wagers and is provided with an initial partial card hand for each wager. The player then receives additional cards which the player assigns to the previously received initial partial hands. The supplemental cards provided to a player for assigning to the initial partial hands can be provided to the player all at once or one at a time.

SUMMARY OF THE INVENTION

The present invention is preferably played with dominoes. The preferability of dominoes obtains for the invention the physical sensation of some weight and sound not found with cards or video presentation of a gaming software, although both of those methods are appropriate for playing the game of the present invention. The present invention is a game of chance, wherein players bet that the ranking and/or point value of their two hands of point value indicators is greater than that of a reference set of hands, the banker's hands.

This present invention comprises a two handed game in which comparison is made between the two hands of a player and a banker. Both hands of the player must have a point total and/or ranking greater than the corresponding two hands of the banker in order to win. Each of the two hands of the player and the banker, a high hand and a low hand, contain only two dominoes or cards.

As practiced, the game of the present invention is preferably played as follows. The Joker Dominoes deck consists of 32 dominoes, playing cards or equivalent representations of such in physical items, devices or as represented in video, digital or electronic form through computer software gaming programs. Playing cards will be used herein to describe the action of the players using such gaming pieces or representations.

The cards further consist of 16 pairs of point value/ranking representations. The point value/ranking representations are preferably those shown in FIG. 1, which include two jokers, two Aces, two Kings, two Queens, two Jacks, two Elevens, two Tens, two Nines, two Eights, two Sevens, two Sixes, two Fives, two Fours, two Threes, two Twos, and two Ones. It is heretofore unknown in gaming to assemble such point value/ranking representations in a single deck, especially with respect to the presence of two Ones.

The game is won by referring to the total point value and/or ranking of the cards in each two-card hand and having a higher ranking or total point value with respect to both hands. Ranking refers to pairs of cards and the face cards, i.e., the jokers, Aces, Kings, Queens and Jacks, however, those cards can also have point value. Although their point value is described below, the face cards as pairs have a ranking from highest to lowest ranking also described below.

Each of the two-card hands consisting of pairs of face cards have a sequentially highest to lowest ranking in the following order: jokers, Aces, Kings, Queens and Jacks. Thereafter in superiority, pairs of cards with the same number have sequentially lower ranking after the pair of Jacks, i.e., a pair of Elevens, a pair of Tens, and so on until a pair of Ones is obtained. Further, the following pairs of unlike face cards have a sequentially descending rank in superiority immediately less than the pair of Ones: King and Queen, King and Jack, and Queen and Jack. This set of rankings of the pairs of face and number cards and of combinations of a King, Queen or Jack with another different card, if that card is a King, Queen or Jack, is superior to any other combination of two unlike cards with any possible total point value.

In addition, ranking further affects the superiority of two-card hands in the following manner. If a King, Queen or Jack is one of the two cards in a two-card hand and the other card has a point value, that hand is superior to another with the same point value only if one of those three face cards is superior in ranking to another of those three face cards in the other hand or if that other hand contains none of those three face cards. With respect to this aspect of ranking, the sequence of superiority for those three face cards is in the following order: King, Queen, Jack.

The jokers have two optional point value capabilities. They can be used as having a point value of 3 or 6 points. Aces can have a point value of one point. Kings, Queens, and Jacks, if played in a hand with the other card having a point value, have a point value of zero.

For any two-card hand, the total point value of that hand can never be greater than the value in the ones column of the sum of the point values of the individual cards, i.e., never greater than 9. For example, if a hand contains a Ten and Eleven, the sum of those numbers is 21, although the total point value of the hand is only I (one). The same total point value is obtained with a hand having a Ten and a One or a Ten and an Ace.

When players approach the playing table, one player volunteers to be a banker and takes a seat at what will be designated as seat number one. Each player must place a bet before any cards are dealt. The person receiving the first set of four cards from the deck will preferably be chosen by a roll of three dice, the highest face value of the dice determining the first player to be dealt a set of four cards. The prevents the players from suspecting that a stacked deck will benefit a fraudulent player.

When each player has dealt to them their four cards, those cards are arranged by the players into two separate hands, a low hand and a high hand. Each hand must consist of only two cards.

The low hand must remain in one stack or side by side and the high hand must remain in another stack or side by side arrangement. Both hands are then played in front of a bet.

After all the players have arranged their four cards into two sets of two cards, their hands are "set", whereby no further re-arrangement or movement may be made of cards between the two hands. After the setting of the player's hands, a banker's hand is exposed ("opened"), set, and compared against each player's hand individually, as in Pai Gow Tiles (Chinese Dominoes). The high hand of a player must be higher in point total than the high hand of the banker. In addition, the low hand of a player must be higher in point total than the low hand of the banker. If such conditions are not met, the player forfeits his be to the banker.

The choice of the banker is preferably also made a part of the game of chance by the method dice point total described below.

DETAILED DESCRIPTION OF THE INVENTION

Figure 1:
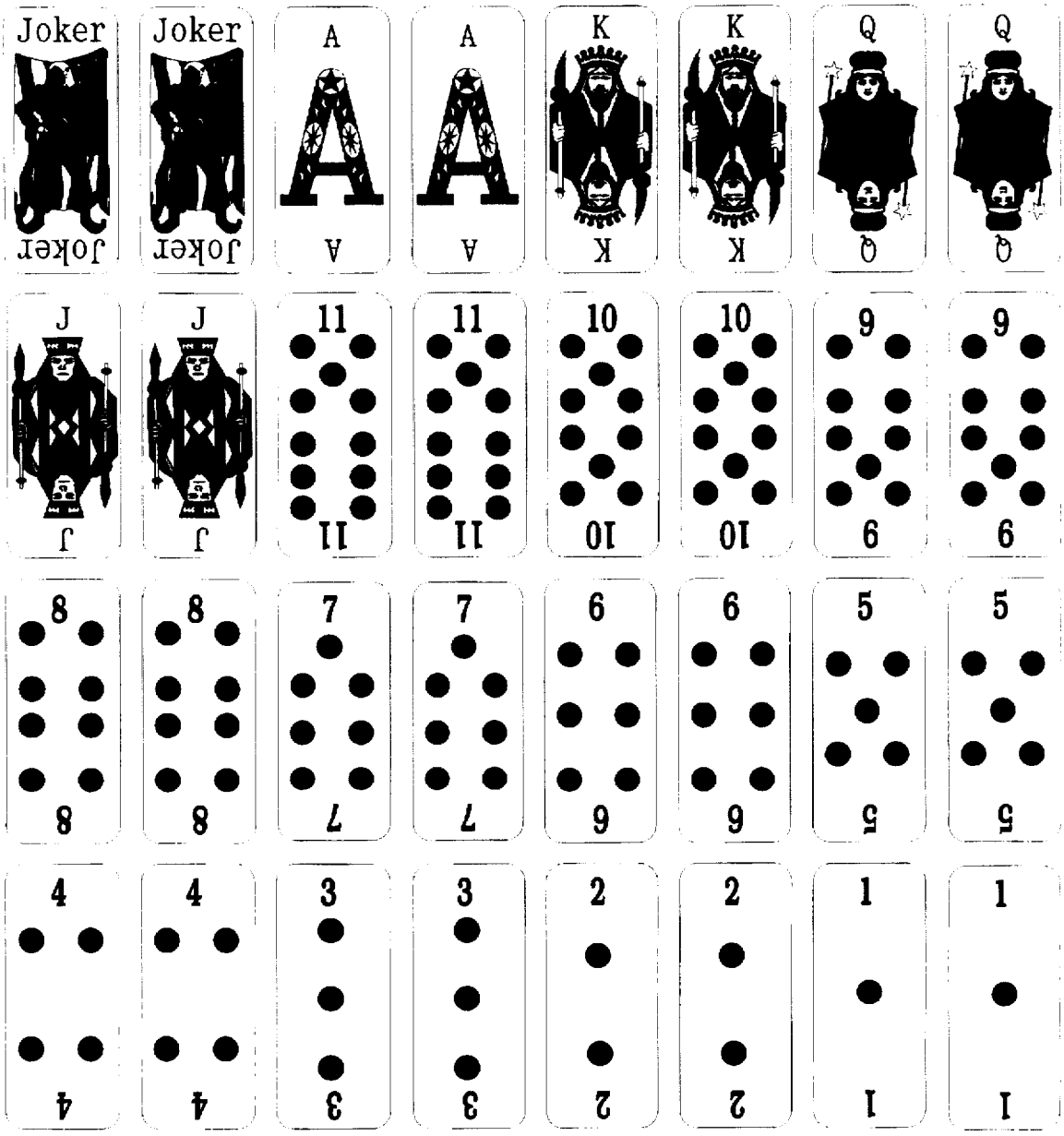
FIG. 1 is a representation of the 32 faces of pairs dominoes preferred according the present invention. Pairs are shown in ranking of superiority in sequentially descending order from the upper left corner and proceeding from left to right through each of the rows to the lowest ranking pair at the lower right corner of the Figure.
Figure 2:
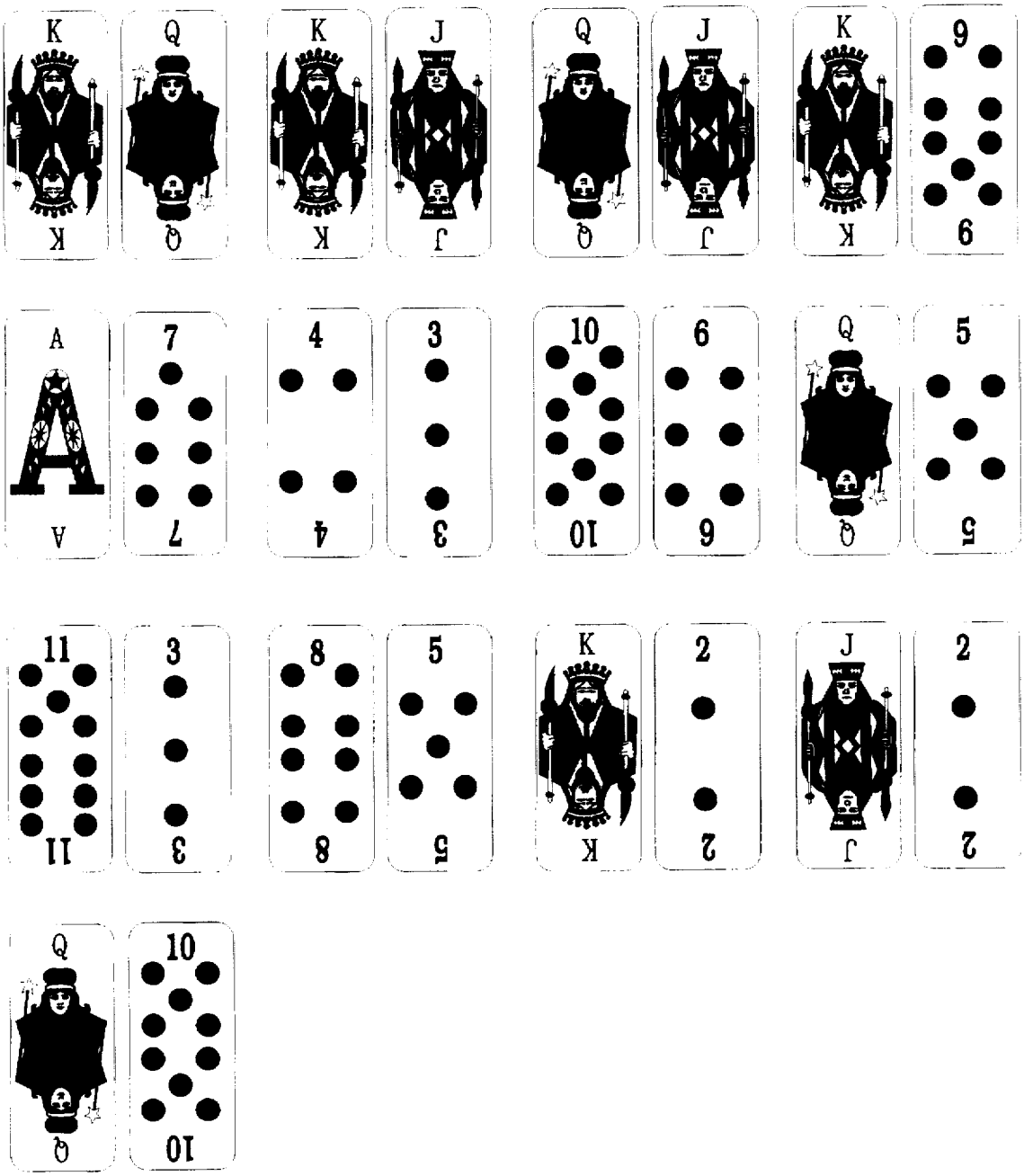
FIG. 2 is a representation of two-card hands of dominoes according the present invention. The two-card hands shown are shown in ranking of superiority in sequentially descending order from the upper left corner and proceeding from left to right through each of the rows to the lowest ranking pair at the lower left corner of the Figure. The total point value of the two-card hands are as follows, starting with the last pair in the top row and proceeding from left to right through each of the rows to the lowest ranking pair at the lower left corner of the Figure: nine, eight, seven, six, five, four, three, two, one, zero.

The method of play of the present invention is now described in detail. Initially, a number of players, either physical or electronically or digitally simulated, gather around a "table". The play proceeds preferably in a clockwise direction starting from an initiating action location, the "action button". That location is determined as described above with respect to the first player to receive their set of four cards. All cards are dealt to each of eight player positions, regardless of the presence of an actual player taking part in the game at that location.

To prevent, surreptitious replacement of cards, all cards dealt during the game must be maintained on the table level at all times. Cards may not be shown nor their point value or ranking in any way communicated to other players from the time the cards are dealt to the point at which the game is complete. At the point that players are seated about the table, each player must place a bet before them before any other action is taken in the game. All bets must be placed before the game is opened.

The position of the banker is preferably voluntary. The banker's position is always 1, 9 and 17, no matter how many players are seated, or decks of cards are used. If the dice point total for a player equals 10, the first player to the left of the banker will be dealt the first hand.

Each player receives four cards. Each player must then form from the four cards a high hand and a low hand. A house dealer is preferably available to shuffle the cards and deal them.

The banker shakes the dice cup with three die and obtains first die total. The total of the dice point value determines who receives the first set of cards and where the action begins. The house dealer should deal four cards to each spot or position at the table.

The banker's hand is presented to the player who is acting as the banker. The hand is "capped" and brought back in by the house dealer for safe keeping until all the players' hand are set. The house dealer may deliver the four cards back to the banker, and let the banker play his or her hand as a player. The players must at this point set their hands irretrievably into high and low hands and leave the cards in position.

The banker will then retrieve the banker's hand and arrange it into high and low hands. The banker's hand will not be set until the banker has signified his or her final decision in an obvious manner to the house dealer. Any players are touching or moving of their cards after the banker retrieves his four cards for arrangement into high and low hands automatically forfeits their bet.

A player may only win if the high and low hands beat the corresponding high and low hands of the banker according the ranking and total point value rules described above. A duplicate or lower ranking or total point value than that of the banker is a losing position.

All players and the bankers must be responsible for the final setting of their own hands, although it is optional to allow the house dealer to assist in setting a player's hands.

The above methods of play will sometimes present the gaming professional with considerable and wide ranges from which to choose appropriate modifications for the above examples. However, the objects of the present invention will still be obtained by the skilled person applying such options in an appropriate manner.

I claim:

1. A method of playing a game of chance comprising the steps of:

(a) two or more players place bets, wherein a first player is named a banker;

(b) providing only one set of point value/ranking, said set indicators consisting, said set of two jokers, two Aces, two Kings, two Queens, two Jacks, two Elevens, two Tens, two Nines, two Eights, two Sevens, two Sixes, two Fives, two Fours, two Threes, two Twos, and two Ones;

(c) dealing each player in a manner which keeps secret ranking and point values a set of four point value/ranking indicators, whereby the non-banker player or players arrange them into a high hand and low hand, consisting of two point value/ranking indicators for each hand;

(d) having the banker then arrange a banker's high hand and low hand consisting of two point value/ranking indicators each;

(e) comparing the ranking and total point values of each player's high hand and low hand, respectively, with the ranking and total point values of the banker's high hand and low hand such that if the banker's ranking and total point values are equal to or higher than those of an individual player, the banker wins the bet of that player.

2. The method of playing a game of chance of claim 1 wherein each of the two-card hands that contain pairs of face cards have a sequentially highest to lowest ranking in the following order: jokers, Aces, Kings, Queens and Jacks.

3. The method of playing a game of chance of claim 2 wherein, after a pair of Jacks in superiority are pairs of cards with the same number and having sequentially lower ranking according the number value of each card.

4. The method of playing a game of chance of claim 3 wherein the following pairs of unlike face cards have a sequentially descending rank in superiority immediately less than the pair of Ones: King and Queen, King and Jack, and Queen and Jack.

5. The method of playing a game of chance of claim 4 wherein the jokers have two optional point value capabilities, whereby they may be valued as having a point value of 3 or 6 points.

6. The method of playing a game of chance of claim 5 wherein Aces have one optional point scoring capability, whereby they may be valued as having a value of one point.

7. The method of playing a game of chance of claim 6 wherein Kings, Queens, and Jacks, if played in a hand with the other card having a point value, have one optional point scoring capability, whereby they may be valued as zero.

8. The method of playing a game of chance of claim 1 wherein the total point value of a two-card hand is equal to the value of the number in the units or ones column of the sum of point values of cards in the two-card hand.

* * * * *